US007438055B1

(12) United States Patent
Xu et al.

(10) Patent No.: US 7,438,055 B1
(45) Date of Patent: Oct. 21, 2008

(54) FUEL INJECTOR TO FUEL RAIL CONNECTION

(75) Inventors: Wenbin Xu, Rochester, NY (US); David A. Webb, Rochester, NY (US); Christopher A. Tucker, Pittsford, NY (US); Christopher M. Cass, Fairport, NY (US)

(73) Assignee: Delphi Technologies, Inc, Troy, MI (US)

( * ) Notice: Subject to any disclaimer, the term of this patent is extended or adjusted under 35 U.S.C. 154(b) by 0 days.

(21) Appl. No.: 11/827,302

(22) Filed: Jul. 11, 2007

(51) Int. Cl.
*F02M 61/14* (2006.01)
*F02M 61/00* (2006.01)

(52) U.S. Cl. ..... 123/470; 123/456

(58) Field of Classification Search ..... 123/470, 123/456, 467, 468, 469, 472; 239/600
See application file for complete search history.

(56) References Cited

U.S. PATENT DOCUMENTS 5,038,738 A * 8/1991 Hafner et al. ..... 123/470
5,209,204 A * 5/1993 Bodenhausen et al. ..... 123/470
5,219,188 A * 6/1993 Abe et al. ..... 285/93
5,301,647 A * 4/1994 Lorraine ..... 123/470
5,724,946 A * 3/1998 Franchitto ..... 123/470
5,842,450 A * 12/1998 Fort et al. ..... 123/463
6,382,187 B1 * 5/2002 Scollard et al. ..... 123/470
6,419,282 B1 * 7/2002 Hornby ..... 285/319
6,539,920 B1 * 4/2003 Spiers ..... 123/456
6,971,684 B2 * 12/2005 Ferrari ..... 285/319
7,107,969 B2 * 9/2006 Norcutt et al. ..... 123/470
2006/0065244 A1 * 3/2006 Norcutt et al. ..... 123/470

* cited by examiner

*Primary Examiner*—Mahmoud Gimie
(74) *Attorney, Agent, or Firm*—Paul L. Marshall

(57) ABSTRACT

A fuel injection system includes a fuel injector socket including a first attachment feature and a fuel injector including a second attachment feature that corresponds with the first attachment feature. The first attachment feature engages with the second attachment feature connecting the fuel injector to the fuel injector socket and preventing rotational movement of the fuel injector relative to the fuel injector socket. The corresponding attachment features not only enable simple connection and disconnection of a fuel injector to a fuel injector socket of a fuel rail, but can also be integrated into existing injector to fuel rail assembly processes and are applicable in any fuel injection system. The corresponding attachment features may be used with metal fabricated fuel rail assemblies as well as for fuel rail assemblies where the manifold supply tube and the fuel injector sockets are overmolded with a plastic material.

26 Claims, 5 Drawing Sheets

FUEL INJECTOR TO FUEL RAIL CONNECTION

TECHNICAL FIELD

The present invention relates to engine management systems and components of internal combustion engines; more particularly, to fuel injection systems; and most particularly, to apparatus and method for connecting a fuel injector to a fuel rail.

BACKGROUND OF THE INVENTION

Fuel rails that are used to deliver fuel to individual fuel injectors of internal combustion engines are well known. A fuel rail assembly, also referred to herein simply as a fuel rail, is essentially an elongated tubular fuel manifold connected at an inlet end to a fuel supply system and having a plurality of ports for mating in any of various arrangements with a plurality of fuel injectors to be supplied. In what is referred to as a return-less system, a fuel return line does not fluidly connect the fuel rail back to the fuel supply system at a rail outlet end. In a "return" system, a fuel line fluidly connects the end of the fuel rail opposite the inlet end back to the fuel supply system. Typically, a fuel rail assembly includes a plurality of fuel injector sockets in communication with a manifold supply tube, the injectors being inserted into the sockets. Fuel rails are typically used on internal combustion engines with multipoint fuel injection systems.

Typically, a fuel injector is connected to a fuel rail using two different methods. In a first prior art method, a clip, such as a c-clip, is used to hold the injector to the fuel injector socket of the fuel rail. The clip also prevents the injector from rotating within the socket. In a second prior art method, a lower and an upper cushion hold the injector between the fuel injector socket and the intake manifold or the cylinder head. In this case the fuel injector socket typically includes a finger that prevents rotation of the injector within the socket. Both prior art methods utilize separate parts, such as the clip or the cushions, which creates extra costs and requires cycle time for installation. Therefore, it is desirable to reduce the number of parts required in the assembly of a fuel injection system.

Efforts to eliminate separate parts for the injector to fuel rail installation have been undertaken in more recent prior art with limited success. Features integrated within the fuel injector socket, the injector, or both, often required relatively tight tolerances, which may result in increased machining time and higher production costs.

U.S. Pat. No. 5,301,647, for example, teaches a fastening clip for integral formation with a portion of the body of a fuel injector and that provides attachment and retention. Modifications to the injector are needed to integrate a cylindrical wall including a plurality of apertures and catches.

U.S. Patent Application No. 2006/0065244, for example, discloses an integral device that provides rotational orientation while allowing axial sliding engagement of the fuel injector relative to the socket after assembly. Retention tabs integrated within the socket engage with corresponding grooves integrated within the injector.

What is needed in the art is a fuel injector to fuel rail connection that does not require separate parts or expensive machining operations.

What is further needed in the art is a relatively simple connection of a fuel injector to a fuel injector socket of a fuel rail that enables efficient assembly as well as disassembly if needed.

It is a principal object of the present invention to provide a method for connecting a fuel injector to a fuel rail that reduces manufacturing cycle time and provides easier package for shipping compared to current methods.

SUMMARY OF THE INVENTION

Briefly described, a fuel injector to fuel rail connection, in accordance with the invention, includes corresponding attachment features integrated into a fuel injector socket of a fuel rail and a fuel injector. The corresponding attachment features not only connect the fuel injector securely to the fuel injector socket of a fuel rail, but also provide a force to prevent injector rotation relative to the socket that is higher than the force provided by known prior art attachment features. By introducing corresponding attachment features in accordance with the invention, separate prior art parts such as clips or cushions can be eliminated simplifying the fuel injector installation process and reducing assembly costs. Furthermore, the corresponding attachment features not only enable simple connection and disconnection of a fuel injector to a fuel injector socket of a fuel rail, but can also be integrated into existing injector to fuel rail assembly processes and are applicable in any fuel injection system. Still further, the corresponding attachment features in accordance with the invention may be used with metal fabricated fuel rail assemblies as well as for fuel rail assemblies where the manifold supply tube and the fuel injector sockets are overmolded with a plastic material.

In accordance with the present invention, the fuel injector socket includes a slot that receives a projection included in the fuel injector. An anti-rotation feature integrated into the slot prevents radial movement of the fuel injector relative to the socket. Fuel pressure prevents axial movement of the fuel injector relative to the socket during operation.

In further accordance with the present invention, the fuel injector socket includes a tab having an anti-rotation feature and securing the socket to a projection integrated in the fuel injector. The injector to socket assembly may be designed either such that the tab is flexible or that the projection includes a locking feature.

In still further accordance with the present invention, the fuel injector includes a groove that includes the anti-rotation feature and receives the socket that includes a tab having an inward pointing lip. During installation, the fuel injector is simply pushed axially into the socket to engage the tab of the socket with the groove of the injector. For disassembly, the fuel injector can be pushed up, rotated, and finally pulled out from the socket.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 2:
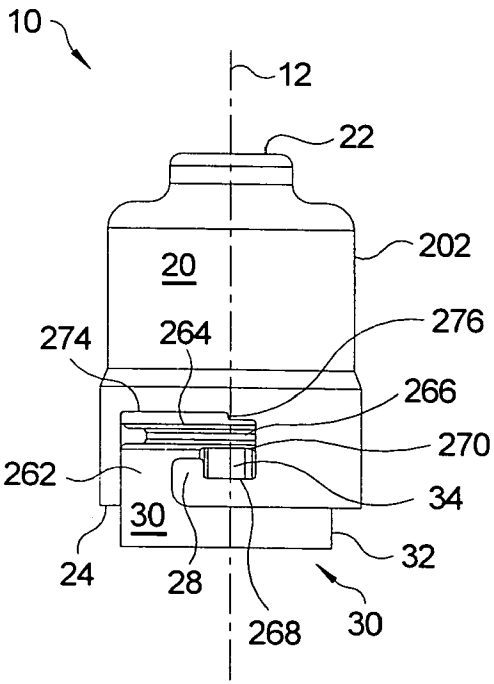
FIG. 2 is a plan front view of the fuel injector installed in the fuel injector socket shown in FIG. 1, in accordance with the invention.
Figure 1:
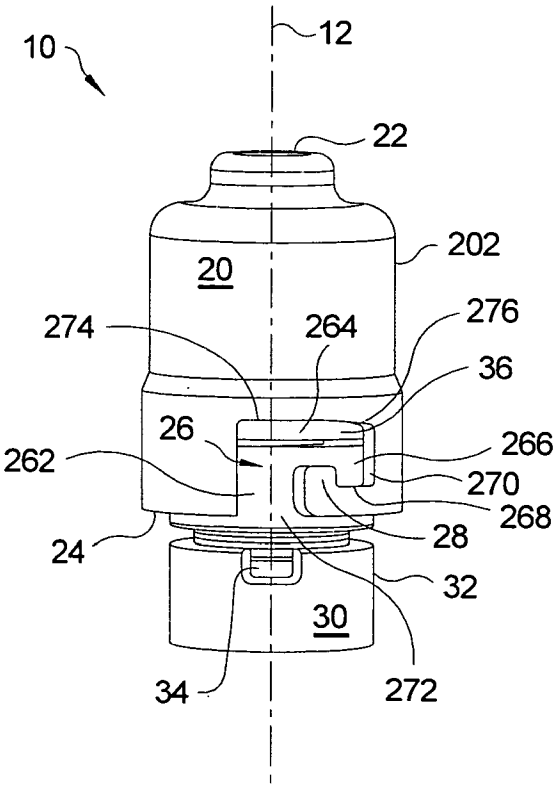
FIG. 1 is an isometric view of a fuel injector and fuel injector socket prior to installation, in accordance with the invention.

Referring to FIGS. 1 and 2, a fuel injection system 10 includes fuel injector socket 20 and fuel injector 30. Fuel injector 30 is shown prior to installation in socket 20 in FIG. 1 and installed in socket 20 in FIG. 2. Fuel injector socket 20 is part of a fuel rail assembly and is in communication with a fuel supply tube (not shown).

Fuel injector socket 20 has a generally cylindrical elongated shape and extends longitudinally along central axis 12 from a first end 22 to a second end 24. The first end 22 is in fluid communication with the fuel supply tube. The second end 24 is open and receives fuel injector 30. Socket 20 includes a primary slot 26 positioned proximate to second end 24. Slot 26 includes a first segment 262, a second segment 264, and a third segment 266, all in fluid communication with each other. First segment 262 extends upwards in axial direction from second end 24 of socket 20 and, therefore is open at end 272. First segment 262 serves as an inlet. Second segment 264 extends radially from end 274 of first segment 262 and connects first segment 262 with third segment 266. Third segment 266 extends downwards from end 276 of second segment 264 in axial direction towards second end 24. Third segment 266 of slot 26 does not extend all the way to second end 24 and, consequently, is closed at bottom 268. Third segment 266 forms an orientation stopper 28 that prevents rotational movement. Fuel injector socket 20 may be manufactured by machining, forming or molding.

Fuel injector 30 includes a primary projection 34 that corresponds with primary slot 26. Projection 34 may have, but is not limited to, a rectangular shape and extends outwards from the outer surface 32 of injector 30. Projection 34 is positioned axially below and at a distance from an o-ring 36 of injector 30 such that projection 34 does not interfere with the sealing process during installation of injector 30 in socket 20. The dimensions of projection 34 are chosen such that projection 34 is able to travel easily within slot 26 of socket 20. The depth of projection 34 is chosen such that projection 34 preferably extends outward beyond the outer surface 202 of socket 20. The width of projection 34 is chosen such that projection 34 fits into third section 266 of slot 26. The height of projection 34 is chosen such that projection 34 can be moved up and down in axial direction within second segment 264 of slot 26.

During installation of injector 30 in socket 20, injector 30 is moved in an axial direction towards the second end 24 of socket 20. The projection 34 of injector 30 is in line with the first section 262 of slot 26 of socket 20. During upward movement of injector 30, the projection 34 enters and travels within first segment 262 of slot 26. By turning injector 30 clockwise (looking upward along central axis 12 in FIG. 1), the projection 34 travels in a radial direction within second segment 264 of slot 26. If the end of second segment 264 is reached, injector 30 is pulled down in an axial direction away from socket 20 and projection 34 travels downwards within third section 266 of slot 26 to a locking position. In the locking position, projection 34 rests at the bottom 268 of third segment 266 of slot 26.

Optionally, as a second method of installation of injector 30 in socket 20, projection 34 may be aligned with third section 266. Then, during upward movement of injector 30, the projection 34 contacts second end 24 and flexes closed bottom 268 away from central axis 12 allowing projection 34 to snap into segment 266. In this position, projection 34 rests at the bottom 268 of third segment 266 of slot 26.

During operation, fuel pressure of fuel supplied by the fuel supply tube (not shown) will press injector 30 down in an axial direction away from socket 20. As a result, projection 34 is held down at the bottom 268 of third segment 266 of slot 26 in a locked position. In this locked position, radial movement of injector 30 relative to socket 20 is prevented clockwise and counter-clockwise by orientation stopper 28 and the wall 270 of third segment 266 of slot 26 opposite from orientation stopper 28, respectively.

During dis-assembly of injector 30 from socket 20, injector 30 is pushed up in an axial direction towards first end 22 of socket 20, is turned counter-clockwise in radial direction (looking upward along central axis 12 in FIG. 1), and finally pulled down in axial direction out of socket 20. During the removal of injector 30 from socket 20, projection 34 travels within slot 26 in an opposite direction as during the first installation method described above.

While socket 20 is shown in FIGS. 1 and 2 to include one slot 26, more than one slot 26 may be included in socket 20. While injector 30 is shown in FIGS. 1 and 2 to include one projection 34, injector 30 may be manufactured with additional projections if socket 20 includes additional slots 26. While second segment 264 of slot 26 is shown in FIGS. 1 and 2 to extend to the right from first segment 262, slot 26 may be designed such that second segment 264 extends to the left from first segment 262. In this case, injector 30 may be rotated counter-clockwise during the first installation method in socket 20 and clockwise during dis-assembly.

Figure 3:
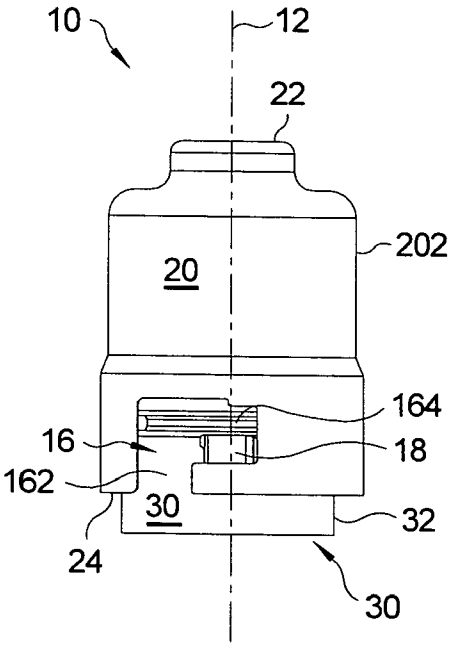
FIG. 3 is a plan back view of the fuel injector installed in the fuel injector socket shown in FIG. 1, in accordance with the invention.

Referring to FIG. 3, fuel injector socket 20 is shown to include an optional secondary slot 16 and fuel injector 30 is shown to include an optional secondary projection 18 that corresponds with secondary slot 16. Slot 16 is preferably positioned at the back of socket 20 opposite from slot 26. Projection 18 is preferably positioned at the back of injector 30 opposite from projection 34. Slot 16 receives projection 18. Projection 18 travels within slot 16 to a supporting position during installation of injector 30 in socket 20.

Slot 16 only includes a first section 162 and a second section 164 that are comparable to first section 262 and second section 264 of slot 26, respectively. By omitting a third segment comparable to segment 266 of slot 26, no orientation stopper 28 is formed. Thus, slot 16 simplifies correct installation of injector 30 in socket 20 and provides additional support for injector 30 in axial direction when installed, but does not provide an anti-rotation structure, such as orientation stopper 28. Slot 16 has generally the same dimensions as slot 26 to ensure effortless installation of injector 30 in socket 20. More than one slot 16 may be included in socket 20 and more than one corresponding projection 18 may be included in injector 30.

Figure 4:
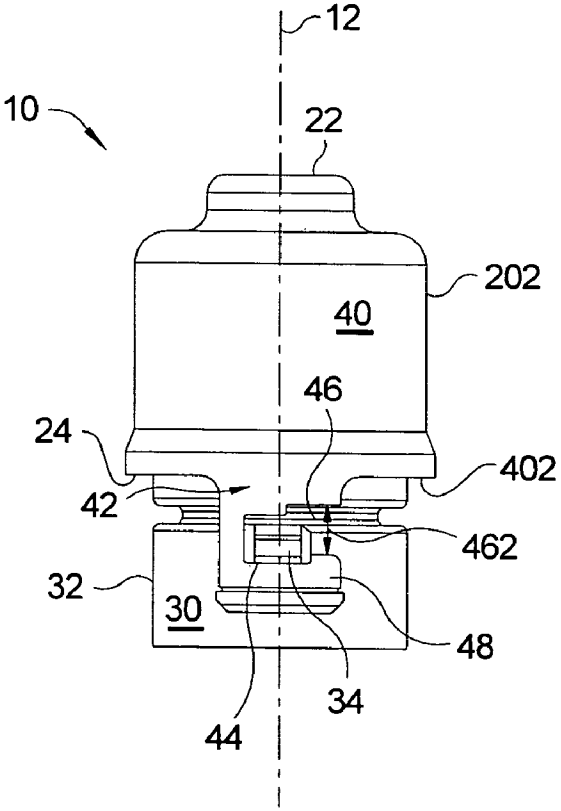
FIG. 4 is a plan front view of a fuel injector installed in another fuel injector socket, in accordance with the invention.

Referring to FIG. 4, socket 40 includes a primary tab 42 in accordance with an alternate embodiment of the invention. Tab 42 extends socket 40 in an axial direction beyond open end 402 of second end 24 of socket 40. Tab 42 includes an opening 46 and a groove 44 that is in fluid communication with opening 46. Groove 44 extends below opening 46 and forms an orientation stopper 48 that prevents movement in radial direction. Injector 30 includes a primary projection 34 as described above with regard to FIGS. 1-3. Projection 34 is designed to fit through opening 46 and into groove 44. Socket 40 may include more than one tab 42 and injector 30 may include more than one corresponding projection 34. Opening 46 may be positioned on either side of tab 42.

During installation of injector 30 in socket 40, injector 30 is moved in axial direction towards the second end 24 of socket 40. The projection 34 of injector 30 is not in line with tab 42. Once injector 30 is pushed into socket 40, injector 30 is turned counter-clockwise (looking upward along central axis 12 in FIG. 4) to move projection towards and through opening 46. Injector 30 is then pulled down in axial direction away from socket 40. This movement causes projection 34 to move into groove 44. In this position, orientation stopper 48 prevents radial movement of injector 30 relative to socket 40.

Optionally, as a second method of installation of injector 30 in socket 40, projection 34 may be aligned with groove 44. Then, during upward movement of injector 30, the projection 34 contacts the bottom of tab 42 and flexes tab 42 away from central axis 12 allowing projection 34 to snap into opening 46 above groove 44. In this position, projection 34 rests in groove 44.

During operation, fuel pressure of fuel supplied by the fuel supply tube (not shown) will press injector 30 down in axial direction away from socket 40. As a result, projection 34 is held in groove 44 in a locking position.

During dis-assembly of injector 30 from socket 40, injector 30 is pushed up in axial direction towards first end 22 of socket 40, moving projection 34 out of the locked position, is turned clockwise in radial direction (looking upward along central axis 12 in FIG. 4) to let projection 34 exit through opening 46 of tab 42, and finally pulled down in an axial direction out of socket 40.

Figure 5:
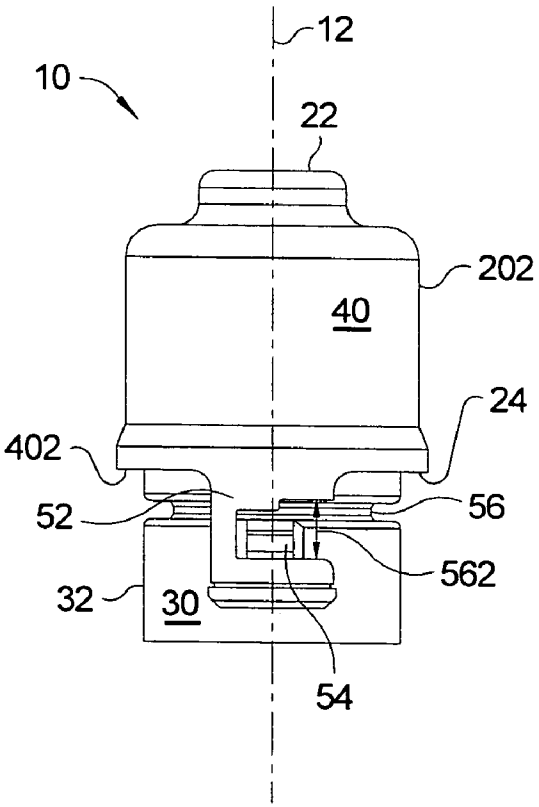
FIG. 5 is a plan back view of the fuel injector installed in the fuel injector socket shown in FIG. 4, in accordance with the invention.

Referring to FIG. 5, socket 40 is shown to include an optional secondary tab 52 and fuel injector 30 is shown to include a corresponding secondary projection 54. Tab 52 is preferably positioned at the back of socket 40 opposite from tab 42. Projection 54 is preferably positioned at the back of injector 30 opposite from projection 34. Tab 52 includes a secondary opening 56, but no groove comparable to groove 44. Opening 56 receives projection 54 during installation of injector 30 in socket 40. Secondary projection 54 moves through opening 56 to a supporting position. The height 562 of opening 56 may be larger than the height 462 of opening 46. Tab 52 simplifies correct installation of injector 30 in socket 40 and provides axial support for installed injector 30, but does not provide anti-rotation support in both radial directions as does tab 42. More than one tab 52 may be included in socket 40 combined with corresponding projections 54 of injector 30. Opening 56 may be positioned on either side of tab 52.

Figure 7:
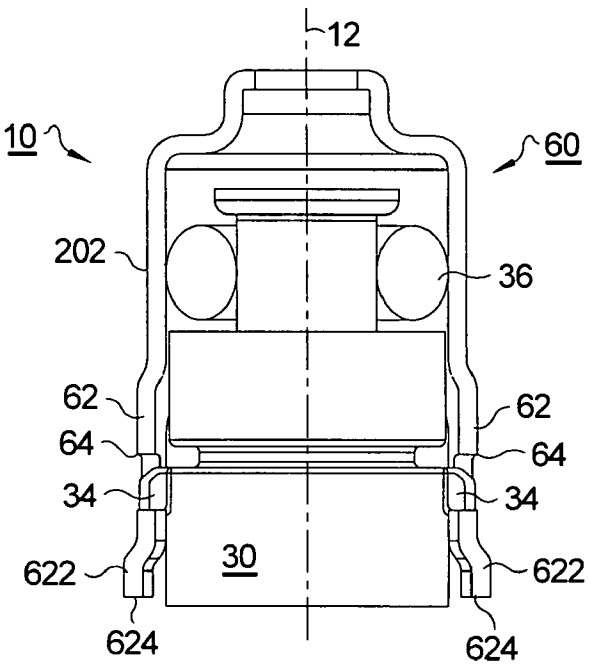
FIG. 7 is a cross-sectional view of the fuel injector installed in the fuel injector socket shown in FIG. 6, in accordance with the invention.
Figure 6:
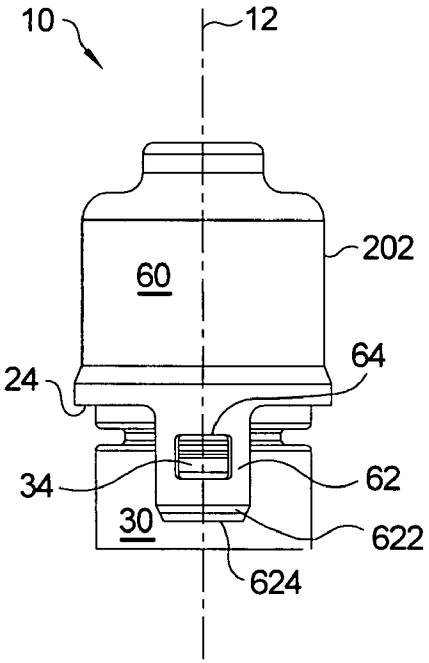
FIG. 6 is a plan front view of a fuel injector installed in another fuel injector socket, in accordance with the invention.
Figure 10:
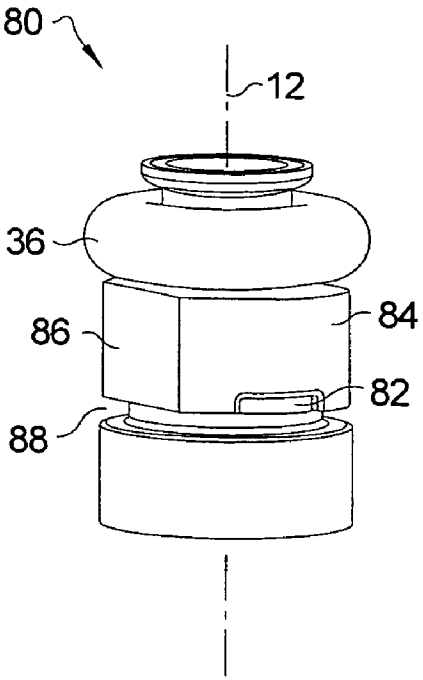
FIG. 10 is an isometric view of the fuel injector shown in FIG. 9, in accordance with the invention.
Figure 9:
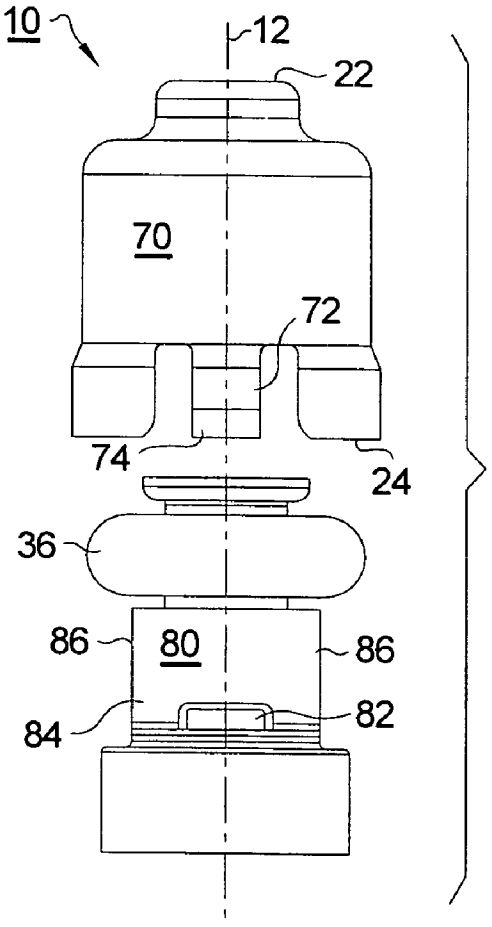
FIG. 9 is a plan front view of a fuel injector and a fuel injector socket prior to installation, in accordance with the invention.
Figure 12:
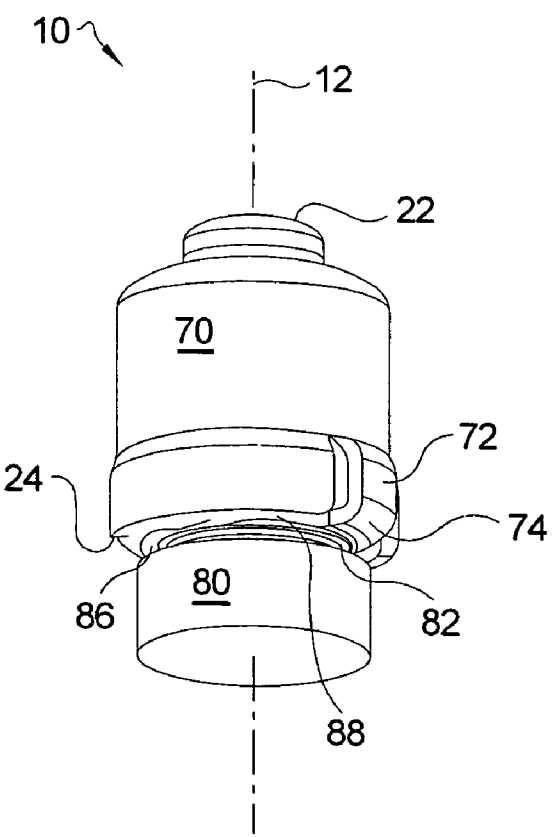
FIG. 12 is an isometric view of the fuel injector installed in the fuel injector socket as shown in FIG. 11, in accordance with the invention.
Figure 11:
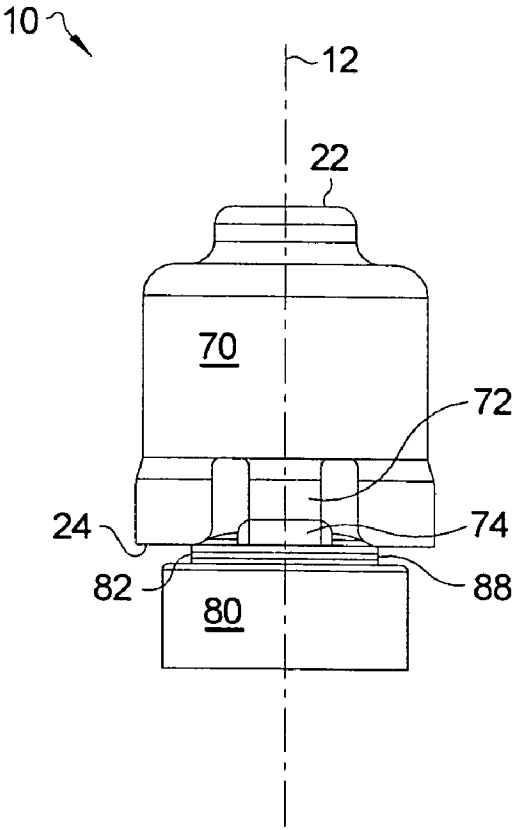
FIG. 11 is a plan front view of the fuel injector installed in the fuel injector socket shown in FIG. 9, in accordance with the invention.

Referring to FIGS. 6 and 7, socket 60 includes multiple tabs 62 in accordance with an alternate embodiment of the invention. Injector 30 includes two projections 34 that correspond with the two tabs 62. In the example shown, tabs 62 and projections 34 are positioned opposite from each other in the cross-sectional view of FIG. 7. More than two tabs 62 may be included in socket 60. Each tab 62 extends socket 60 beyond second end 24 in axial direction. Each tab 62 includes a void 64. Void 64 has a shape corresponding the shape of projection 34. The size of void 64 is selected such that void 64 can receive and enclose projection 34. Tabs 62 may be designed to be flexible. Tabs 62 may be able to flex away from axis 12. Tabs 62 include a ramp 622 that extends axially below the void 64 and that is slightly bent outward away from axis 12 (as shown in FIG. 7). Ramps 622 aid the installation process of injector 30 in socket 60.

During installation, the fuel injector 30 is moved in an axial direction towards the second end 24 of socket 60. The projections 34 of injector 30 are preferably in line with corresponding tabs 62. During the axial upward movement, projections 34 will slide underneath ramps 622 of corresponding tabs 62 flexing tabs 62 at end 624 outward and away from axis 12 until the voids 64 are reached. When projections 34 enter corresponding voids 64, tabs 62 will flex back towards axis 12 into resting position thereby locking projections 34 in place. Tabs 62 including voids 64 limit axial movement and prevent radial movement of injector 30 relative to socket 60 when installed during operation. For dis-assembly, tabs 62 are flexed outwards away from axis 12 and injector 30 is pulled downward in axial direction out of socket 60.

Figure 8:
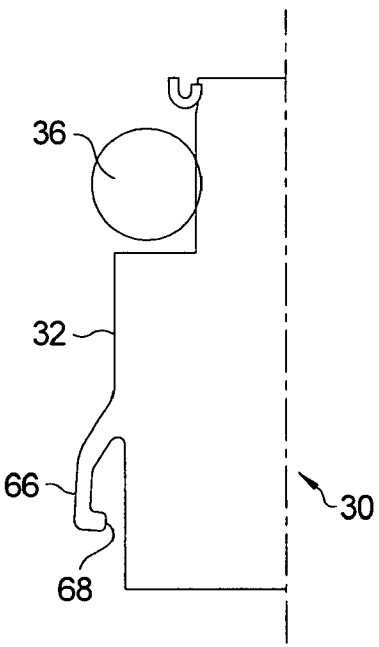
FIG. 8 is a partial cross-sectional view of the fuel injector similar to the injectors shown in FIGS. 6 and 7, but with a flexible extended projection, in accordance with the invention.

Referring to FIG. 8, injector 30 includes a flexible projection 66 in accordance with an alternate embodiment of the invention. Injector 30 may be installed in socket 60 as illustrated in FIGS. 6 and 7. Replacing projections 34 shown in FIGS. 6 and 7 with flexible projection 66 shown in FIG. 8 may provide a higher force to prevent rotation of injector 30 within socket 60 and may also position injector 30 more securely and reliably in socket 60. Projection 66 may be designed to be flexible, including a hook portion extending downward in an axial direction. Projection includes tip 68.

During installation of injector 30 in socket 60 (shown in FIGS. 6 and 7), tabs 62 slide over corresponding projections 66 during upward movement of injector 30 into socket 60 flexing tip 68 of projection 66 inwards. Once projection 66, including tip 68, aligns with void 64, upward movement of injector 30 is stopped. At that point, tip 68 flexes back outward and away from axis 12, thereby locking the injector in place. For dis-assembly, tip 68 of projection 66 is flexed inward toward axis 12 to enable pulling injector 30 out of socket 60.

Referring to FIGS. 9-12, fuel injection system 10 includes fuel injector socket 70 and fuel injector 80 according to an alternative embodiment of the invention. Fuel injector 80 is shown prior to installation in socket 70 in FIG. 9 and installed in socket 70 in FIGS. 11 and 12. Socket 70 includes a tab 72 integrated into the body of socket 70.

Tab 72 does not extend beyond second end 24 of socket 70. Tab 72 is designed to be flexible allowing tab 72 to be flexed outward away from axis 12. Tab 72 includes an inward oriented lip 74 positioned proximate to the second end 24. In a preferred embodiment, socket 70 includes at least two tabs 72 that are positioned radially equal-spaced from each other.

Injector 80 includes a notch 82. Notch 82 may be integrated in the body of injector 80 and may be located within a section 84 below o-ring 36. Notch 82 is designed to receive lip 74 of socket 70. Section 84 of injector 80 includes a flat sidewall 86 that is, in the example shown having two tabs, at a 90-degree angle to notch 82. In a preferred embodiment, injector 80 includes at least two notches 82 that are positioned opposite from each other and at least two flat sidewalls 86. One sidewall 86 is always positioned between two notches 82. Injector 80 further includes an annular groove 88 positioned just below notches 82.

During installation of injector 80 in socket 70, notches 82 are lined up with corresponding tabs 72. Injector 80 is pushed upward in axial direction towards socket 70. During the upward movement, tabs 74 are flexed outward. When lips 74 meet corresponding notches 82, lips 74 engage with notches 82.

To dis-assemble injector 80 from the socket, injector 80 is pushed upward such that lips 74 of tabs 72 disengage from notches 82 and slide into annular groove 88. Injector 80 is then rotated, either clock-wise or counter-clockwise, until lips 74 are lined up with flat sidewalls 86. Now, injector 80 is pulled out from socket 70 by moving injector 80 downward in axial direction away from socket 70. During this movement, lips 74 slide over flat sidewalls 86 releasing injector 80.

As compared to the prior art, fuel injection system 10, in accordance with the invention, beneficially provides corresponding attachment features integrated in fuel injector sockets 20, 40, 60 and 70 and integrated in fuel injectors 30 and 80 that not only connect the fuel injector 30 securely to the fuel injector sockets 20, 40, and 60 and the injector 80 to socket 70, but also provide a higher force to prevent injector rotation relative to the socket. Stronger anti-rotation structures, for example orientation stopper 28 and 48, tab 62 and void 64, or tab 72 and notch 82, are provided, while the connection of injector to socket is simplified. Hence, lower manufacturing and assembly costs, reduced manufacturing and assembly cycle times, and easier packaging conditions are obtained.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A fuel injection system, comprising:

a fuel injector socket including a primary slot including a first, a second, and a third segment; and a fuel injector including a corresponding primary projection extending outward from an outer surface of said fuel injector, wherein said primary projection is received by said primary slot, and wherein said primary projection engages with said primary slot connecting said fuel injector to said fuel injector socket and preventing rotational movement of said fuel injector relative to said fuel injector socket.

2. A fuel injection system, comprising:

a fuel injector socket including a primary slot including a first, a second, and a third segment; and a fuel injector including a corresponding primary projection extending outward from an outer surface of said fuel injector, wherein said primary projection travels within said primary slot from said first segment to a locking position at the bottom of said third segment, and wherein said primary projection engages with said primary slot connecting said fuel injector to said fuel injector socket and preventing rotational movement of said fuel injector relative to said fuel injector socket.

3. The fuel injection system of claim 2, wherein said fuel injector socket further includes a secondary slot positioned opposite from said primary slot, wherein said fuel injector further includes a corresponding secondary projection positioned opposite from said primary projection, and wherein said secondary projection travels within said secondary slot to a supporting position.

4. A fuel injection system, comprising:

a fuel injector socket including a body having an open end, said fuel injector socket further including a primary tab including an opening in fluid communication with a groove, said primary tab extending beyond said open end of the body of said fuel injector socket; and a fuel injector including a corresponding primary projection extending outward from an outer surface of said fuel injector, wherein said primary projection is received by said opening, and wherein said primary projection engages with said primary tab connecting said fuel injector to said fuel injector socket and preventing rotational movement of said fuel injector relative to said fuel injector socket.

5. A fuel injection system, comprising:

a fuel injector socket including a primary tab including an opening in fluid communication with a groove and extending beyond the body of said fuel injector socket; and a fuel injector including a corresponding primary projection extending outward from an outer surface of said fuel injector, wherein said primary projection moves through said opening to a locking position in said groove, and wherein said primary projection engages with said primary tab connecting said fuel injector to said fuel injector socket and preventing rotational movement of said fuel injector relative to said fuel injector socket.

6. The fuel injection system of claim 5, wherein said fuel injector socket further includes a secondary tab positioned opposite from said primary tab and including a secondary opening, wherein said fuel injector further includes a corresponding secondary projection positioned opposite from said primary projection, and wherein said secondary projection moves through said secondary opening to a supporting position.

7. A fuel injection system, comprising:

a fuel injector socket including a first tab including a first void and a second tab including a second void; and a fuel injector including a first corresponding projection and a second corresponding projection, wherein said first void receives and encloses said first projection, wherein said second void receives and encloses said second projection, wherein said first and second projections engage with said corresponding first and second tabs connecting said fuel injector to said fuel injector socket and preventing rotational movement of said fuel injector relative to said fuel injector socket.

8. The fuel injection system of claim 7, wherein said first and second projection is a hook extending downward in axial direction from an outer surface of said fuel injector and including an inward pointed tip.

9. A fuel injection system, comprising:

a fuel injector socket including a first tab including a first inward oriented lip and a second tab including a second inward oriented lip; and a fuel injector including a first corresponding notch and a second corresponding notch, wherein said first notch receives said first lip, wherein said second notch receives said second lip, wherein said first and second notches engage with said corresponding first and second tabs connecting said fuel injector to said fuel injector socket and preventing rotational movement of said fuel injector relative to said fuel injector socket.

10. A fuel injector to fuel rail connection, comprising:

a fuel injector including a primary projection extending outward from an outer surface of said fuel injector; and a fuel injector socket having an open end that receives said fuel injector and including a corresponding primary slot having a first, a second, and a third segment; and wherein said primary projection is received by said primary slot.

11. The fuel injector to fuel rail connection of claim 10 wherein said primary projection travels within said primary slot from said first segment to a locking position at the bottom of said third segment connecting said fuel injector to said fuel injector socket and preventing rotational movement of said fuel injector relative to said fuel injector socket.

12. The fuel injector to fuel rail connection of claim 10, wherein said first segment extends upwards in axial direction from said open end, wherein said second segments extends radially from said first segment, wherein said third segment extends downwards in axial direction from said second segment to said bottom, and wherein said first, second and third segment are in fluid communication with each other.

13. The fuel injector to fuel rail connection of claim 10, wherein said third segment forms an orientation stopper that prevents said rotational movement.

14. The fuel injector to fuel rail connection of claim 10, wherein said fuel injector socket further includes a secondary slot positioned opposite from said primary slot and including a first segment and a second segment, wherein said first segment extends upwards in axial direction from said open end, wherein said second segments extends radially from said first segment, wherein said fuel injector further includes a corresponding secondary projection positioned opposite from said primary projection, and wherein said secondary projection is received by said secondary slot.

15. The fuel injector to fuel rail connection of claim 14 wherein said secondary projection travels within said secondary slot to a supporting position within said second segment.

16. A fuel injector to fuel rail connection comprising:

a fuel injector including a primary projection extending outward from an outer surface of said fuel injector; and a fuel injector socket having an open end that receives said fuel injector and including a corresponding primary tab including an opening in fluid communication with a groove, said primary tab extending beyond said open end in an axial direction;

wherein said primary projection is received by said primary tab.

17. The fuel rail injector connection of claim 16 wherein said primary projection moves through said opening to a locking position in said groove connecting said fuel injector to said fuel injector socket and preventing rotational movement of said fuel injector relative to said fuel injector socket.

18. The fuel injector to fuel rail connection of claim 16, wherein said groove extends below said opening and forms an orientation stopper that prevents said rotational movement.

19. The fuel injector to fuel rail connection of claim 16, wherein said fuel injector socket further includes a secondary tab positioned opposite from said primary tab and including a secondary opening, wherein said secondary tab extends beyond said open end of said fuel injector socket, wherein said fuel injector further includes a corresponding secondary projection positioned opposite from said primary projection, and wherein said secondary projection is received by said secondary tab.

20. The fuel injector to fuel rail connection of claim 19 wherein said secondary projection moves through said secondary opening to a supporting position.

21. A fuel injector to fuel rail connection, comprising:

a fuel injector including a first projection and a second projection positioned opposite from said first projection, said first and second projection extending outward from an outer surface of said fuel injector; and a fuel injector socket having an open end that receives said fuel injector and including a first corresponding tab including a first void and a second corresponding tab positioned opposite from said first tab and including a second void, said first and second tab extending beyond said open end in axial direction;

wherein said first void receives and encloses said first projection and wherein said second void receives and encloses said second projection connecting said fuel injector to said fuel injector socket and preventing rotational movement of said fuel injector relative to said fuel injector socket.

22. The fuel injector to fuel rail connection of claim 21, wherein said first tab and said second tab are flexible, and wherein said first tab and said second tab each include a ramp that extends axially below said first void and said second void, respectively, wherein said ramp is bent outward.

23. The fuel injector to fuel rail connection of claim 21, wherein said first and second projection is a hook extending downward in axial direction from said outer surface of said fuel injector and including an inward pointed first and second tip respectively, and wherein said first and second tip engage said first and second tab.

24. A fuel injector to fuel rail connection, comprising:

a fuel injector including a first notch, a second notch positioned opposite from said first notch, a first flat sidewall positioned between said first notch and said second notch, a second flat sidewall positioned opposite from said first sidewall, and an annular groove positioned below said first and second notch; and a fuel injector socket having an open end that receives said fuel injector and including a first corresponding tab including a first inward oriented lip and a second corresponding tab positioned opposite from said first tab and including a second inward oriented lip, said first and second tab being integrated within said fuel injector socket;

wherein said first notch receives and engages said first lip, and wherein said second notch receives and engages said second lip connecting said fuel injector to said fuel injector socket and preventing rotational movement of said fuel injector relative to said fuel injector socket.

25. The fuel injector to fuel rail connection of claim 24, wherein said annular groove receives said first and second lip, wherein said first and second lip move within said annular groove until lined up with said first and second sidewall, and wherein said first and second lip slide over said first and second sidewall, respectively, during a downward movement of said fuel injector relative to said fuel injector socket.

26. The fuel injector to fuel rail connection of claim 24, wherein said first and second notch is integrated in the body of said fuel injector below an o-ring.

* * * * *